US010900701B2

(12) United States Patent
De Los Santos Juan

(10) Patent No.: US 10,900,701 B2
(45) Date of Patent: Jan. 26, 2021

(54) BULK ICE PRESERVER

(71) Applicant: Pedro Enrique De Los Santos Juan, Montijo (ES)

(72) Inventor: Pedro Enrique De Los Santos Juan, Montijo (ES)

( * ) Notice: Subject to any disclaimer, the term of this patent is extended or adjusted under 35 U.S.C. 154(b) by 0 days.

(21) Appl. No.: 15/558,706

(22) PCT Filed: Mar. 15, 2016

(86) PCT No.: PCT/ES2016/070170
§ 371 (c)(1),
(2) Date: Sep. 15, 2017

(87) PCT Pub. No.: WO2016/146874
PCT Pub. Date: Sep. 22, 2016

(65) Prior Publication Data

US 2018/0112904 A1 Apr. 26, 2018

(30) Foreign Application Priority Data

Mar. 16, 2015 (ES) ..... 201500193 U

(51) Int. Cl.
*F25C 5/182* (2018.01)
*F25C 1/00* (2006.01)
*F25C 5/00* (2018.01)

(52) U.S. Cl.
CPC ..... *F25C 5/182* (2013.01); *F25C 1/00* (2013.01); *F25C 5/00* (2013.01); *F25C 2500/08* (2013.01)

(58) Field of Classification Search
CPC .... F25C 5/182; F25C 1/00; F25C 5/00; F25C 2500/08
(Continued)

(56) References Cited

U.S. PATENT DOCUMENTS 2,645,910 A * 7/1953 Leeson ..... F25C 1/06 62/71
2,804,996 A * 9/1957 Werner ..... B67D 1/16 222/108
(Continued)

FOREIGN PATENT DOCUMENTS

CN 202304170 U 7/2012
ES 1094183 U 11/2013
(Continued)

OTHER PUBLICATIONS

International Search Report for International Application No. PCT/ES2016/070170 (May 24, 2016) (2 Pages).

*Primary Examiner* — Len Tran
*Assistant Examiner* — Kirstin U Oswald
(74) *Attorney, Agent, or Firm* — Lucas & Mercanti, LLP

(57) ABSTRACT

An apparatus for preserving bulk ice that includes a compartment for drying and storing ice, and a shaft for attaching an ice drying receptacle to the drying and storage compartment is disclosed. The shaft is actuated by a motor having two directions of rotation. The motor is adapted to cause the shaft and ice drying receptacle to rotate in two directions. The action of the motor, and therefore the rotation of the shaft and the ice drying receptacle, are controlled based in part on information received from one or more sensors. The compartment also has a tray with a drain for collecting and removing waste. The tray includes a resistor for melting the remains of the drying process.

3 Claims, 3 Drawing Sheets

(58) Field of Classification Search
USPC ..... 62/344, 320, 354
See application file for complete search history.

(56) References Cited

U.S. PATENT DOCUMENTS 2,995,017 A * 8/1961 Breeding ..... F25C 1/12 62/157
3,021,686 A * 2/1962 Alt ..... F25C 5/187 62/132
3,027,731 A * 4/1962 Lindenberg ..... F25C 1/08 62/138
3,045,445 A * 7/1962 MacLeod ..... F25C 5/187 62/137
3,045,719 A * 7/1962 Burks ..... G07F 17/0071 141/104
3,098,363 A * 7/1963 Shrader ..... F25B 47/022 62/151
3,112,622 A * 12/1963 Bollefer ..... F25C 1/147 62/320
3,151,668 A * 10/1964 Zimmermann ..... G07F 11/68 222/146.1
3,225,968 A * 12/1965 Winkler ..... F25C 5/20 222/238
3,394,558 A * 7/1968 Fisher ..... F25C 1/04 62/233
3,423,949 A * 1/1969 Esser ..... F25C 1/12 62/73
3,423,952 A * 1/1969 Pugh ..... F25C 1/12 62/138
3,543,811 A * 12/1970 Atkins ..... F25C 5/20 141/9
3,605,430 A * 9/1971 Conti ..... F25D 3/02 62/137
3,664,150 A * 5/1972 Patterson ..... F25B 5/02 62/234
3,825,158 A * 7/1974 Morris, Jr. ..... F25C 5/18 222/238
3,913,343 A * 10/1975 Rowland ..... F25C 5/20 62/137
3,964,270 A * 6/1976 Dwyer ..... F25C 1/045 62/138
4,009,595 A * 3/1977 Barnard ..... F25C 1/12 62/300
4,088,243 A * 5/1978 Deveson ..... F25C 5/20 221/93
4,192,151 A * 3/1980 Carpenter ..... F25C 1/12 62/320
4,252,002 A * 2/1981 Mullins, Jr. ..... F25C 5/24 62/344
4,276,750 A * 7/1981 Kawasumi ..... B67D 1/00 62/137
4,402,194 A * 9/1983 Kuwako ..... F25C 1/04 318/282
4,448,032 A * 5/1984 Hibino ..... C02F 1/22 414/269
4,719,765 A * 1/1988 Hooper ..... F25C 5/182 362/290
4,722,199 A * 2/1988 Hibino ..... F25C 5/182 49/496.1
4,732,301 A * 3/1988 Tobias ..... F25C 5/24 222/203
4,771,609 A * 9/1988 Funabashi ..... F25C 5/20 62/137
4,788,830 A * 12/1988 Schreiner ..... F25C 5/182 414/306
4,910,974 A * 3/1990 Hara ..... F25C 1/045 62/347
5,131,234 A * 7/1992 Furukawa ..... F25C 5/187 200/61.2
5,142,878 A * 9/1992 Hida ..... F25C 1/147 62/137
5,207,761 A * 5/1993 Ruff ..... C02F 1/22 62/124
5,245,841 A * 9/1993 Paul ..... F25C 1/12 312/257.1
5,345,782 A * 9/1994 Takahashi ..... F25C 1/12 62/344
5,505,055 A * 4/1996 Franklin, Jr. ..... F25C 1/00 62/239
6,439,428 B1 * 8/2002 Schroeder ..... B67D 1/00 222/64
9,273,894 B1 * 3/2016 Whitty ..... F25C 1/00
2006/0005553 A1 * 1/2006 Metzger ..... B65B 1/36 62/135
2007/0089451 A1 * 4/2007 Lee ..... F25C 1/12 62/352
2007/0240441 A1 * 10/2007 Hobson ..... F25C 1/00 62/233
2007/0273259 A1 * 11/2007 Sellers ..... F25C 5/182 312/401
2008/0110129 A1 * 5/2008 LeBlanc ..... B65B 61/025 53/127
2009/0278024 A1 * 11/2009 K.V. ..... F25C 5/182 248/678
2009/0320513 A1 * 12/2009 Yamaoka ..... F25D 23/003 62/340
2010/0193546 A1 * 8/2010 Jennison ..... F25C 5/20 222/167
2010/0205985 A1 * 8/2010 Chang ..... G07F 17/0071 62/137
2011/0314860 A1 * 12/2011 Tafoya ..... F25C 5/182 62/344

FOREIGN PATENT DOCUMENTS

GB 751208 A 6/1956
WO 2013178857 A1 12/2013
WO 2015092111 A1 6/2015

* cited by examiner

BULK ICE PRESERVER

CROSS REFERENCE TO RELATED APPLICATION

This Application is a 371 of PCT/ES2016/070170 filed on Mar. 15, 2016, which claims priority of Spanish Application No. filed U201500193 Mar. 16, 2015, both of which are incorporated herein by reference.

OBJECT OF THE INVENTION

The present invention falls under two main industries, the hospitality industry and the ice maker industry. It is a bulk ice preserver with a new ice cube drying system that provides higher-quality drying, with less ice breakage and completely soundless, which can include a built-in ice maker in its interior or, if not built-in, an ice-making machine is placed atop the bulk ice preserver, with which it synchronises its operation in order to store the ice cubes with the maximum possible quality, loose and separate from each other and with the same size as when they were just made.

BACKGROUND

There are currently different units for preserving ice cubes so they do not thaw in unrefrigerated silos. Some ice makers incorporate industrial ice dryers, which are very large and expensive units built to preserve several tonnes of ice on a daily basis. In the hospitality industry there are also units with high manual load, which depend exclusively on the operator to be able to preserve the ice in freezers with a certain degree of quality. And, lastly, automated ice drying units are also known in the hospitality industry, with very complex and expensive mechanisms, and all these aforementioned units make a lot of noise during the drying process due to having vibrator motors that make a lot of noise because they prevent the ice cubes from sticking together due to the timed activation of the vibratory motor, ensuring that the ice cubes vibrate, but the tray and the metal structure fastened to the automated dryers also vibrate. Therefore, they must be installed in storerooms or isolated places in hotel establishments so they do not bother customers or neighbours when they are drying the ice cubes.

The unit of the invention has a novel, cheap and simple system for preserving bulk ice cubes, in the best possible conditions, with the same size as when they were just made and all the ice cubes loose and separate from each other. This is achieved through a simple and novel ice cube drying system produced by a rotation system that makes the ice cubes turn over one another to prevent them from sticking together when drying, without the bulk ice preserver making any noise, since it does not have the noisy drying system of the vibrator motors of all the aforementioned current units, due to which the owner of the establishment can install it on the counter, in the main room of the establishment or wherever the owner of the establishment wishes without its operation bothering customers or neighbours.

DESCRIPTION OF THE INVENTION

The invention relates to a bulk ice preserver which can have a built-in ice maker in its interior and, if it is not built-in, an ice-making machine can be placed atop the bulk ice preserver. By synchronising the operation of the ice maker and the bulk ice-preserving unit so that the moisture with which the ice cubes are discharged from the ice makers is removed from all the ice cubes of each ice maker production cycle while a new ice cycle is under way, since all the ice-making units discharge the ice cubes by thawing. Due to this initial thawing, if we do not quickly introduce the ice cubes into a compartment below zero, they thaw and quickly deteriorate. And the longer we take to store them the more thawed they are, the smaller they are and the more water they have on their outer layer. And all this moisture or water on the exterior of the ice cubes causes the ice cubes to stick together and form blocks of ice cubes when they are refrozen, greatly hindering waiters' work.

The bulk ice preserver comprises:

An ice cube drying and storage compartment which has a static or forced cold unit.

An ice drying unit inside the ice cube drying and storage compartment. This unit is formed by:

1. A simple structure for fastening the ice-drying receptacle and the drain tray to the ice drying and storage compartment.
2. An ice-drying receptacle which can have different shapes (oval, round, cylindrical, etc.) to ensure the ice cubes easily turn over one another, having an opening at the top of the drying receptacle through which the ice is loaded in its interior and, when the drying receptacle rotates, said opening is placed at the bottom thereof, through which ice is discharged by gravity into the storage compartment. This opening of the ice drying receptacle could optionally include a door for loading and discharging the ice by opening and closing it.
3. A motor with double direction of rotation that causes the rotation of the rod that is joined to the drying receptacle towards both sides in order to rotate the ice drying receptacle to ensure that the ice cubes in its interior turn over one another in the receptacle to prevent them from sticking together while drying; the motor with double direction of rotation also placing the ice cubes in a position so as to be loaded into and discharged from the ice drying receptacle when the programmable automaton or relay instructs it to do so.
4. One or various sensors that mark the loading/discharge position and the timed ice drying movements with the help of these sensors. They are activated in accordance with the signals it receives from the programmable automaton or relay.
5. A drainage tray for collecting the waste generated by the ice drying process and the water discharged by the ice maker. This tray has the option of having a resistor to melt the pieces of ice and prevent the water from freezing and blocking the drain of the tray that collects the remains of the drying process.
6. An indicator or sensor to alert us that the ice storage compartment is full, proceeding to send a signal to stop the production of the ice maker until the operator removes the ice from the storage compartment and releases the sensor signal, restarting the ice maker and the automated drying system.
7. Luminous indicators to alert the operator when the unit is in operation or is stopped because the ice compartment is full, or of possible incidents in the unit.

The bulk ice preserver provides the following advantages over current units:

It completely eliminates the bothersome noise made by current drying units, since it does not have vibrator motors which are evidently responsible for the noise, and the new system allows the bulk ice preservers to be installed anywhere inside the hotel establishment and even on counters or in the rooms of the establishments.

It has higher ice drying quality, since the new system does not require the ice cubes to vibrate against each other, but rather slide to one side and then to the other inside the ice drying receptacle. Thus preventing sharp impacts between them and imperfections in the ice cubes.

The new drying system is much simpler, smaller, cheaper and easier to install, because by optimising both costs and size with this new drying system, a much larger market share can be obtained because potential customers no longer have to be major ice consumers, since the bulk ice preserver enables customers with an average consumption of ice to quickly obtain returns on their investment in the units, thereby considerably increasing their market share and selling a much larger number of machines, whereupon many more hoteliers would benefit from the numerous advantages of bulk ice preservers while protecting the environment, since 100% of the ice made is used, thereby consuming less water and less electricity.

BRIEF DESCRIPTION OF THE FIGURES

What follows is a very brief description of drawings that help to better understand the invention and which is presented as a non-limiting example thereof.

1. Ice maker.
2. Joining duct that joins the ice maker to the ice drying and storage compartment.
3. Ice drying and storage compartment.
4. Fastening structure that fastens the ice drying receptacle to the drying and storage compartment.
5. Ice drying receptacle.
6. Motor with double direction of rotation.
7. Sensor or end of travel.
8. Drying process waste collection tray.
9. Resistor.
10. Sensor or photocell.
11. Cold unit of the ice drying and storage compartment.
12. Ice drying and storage compartment doors.
13. Bulk ice preserver operation indicators.
14. Ice storage.
15. Automaton or similar.
16. Drains.
17. Ice drying receptacle door.

Figure 2:
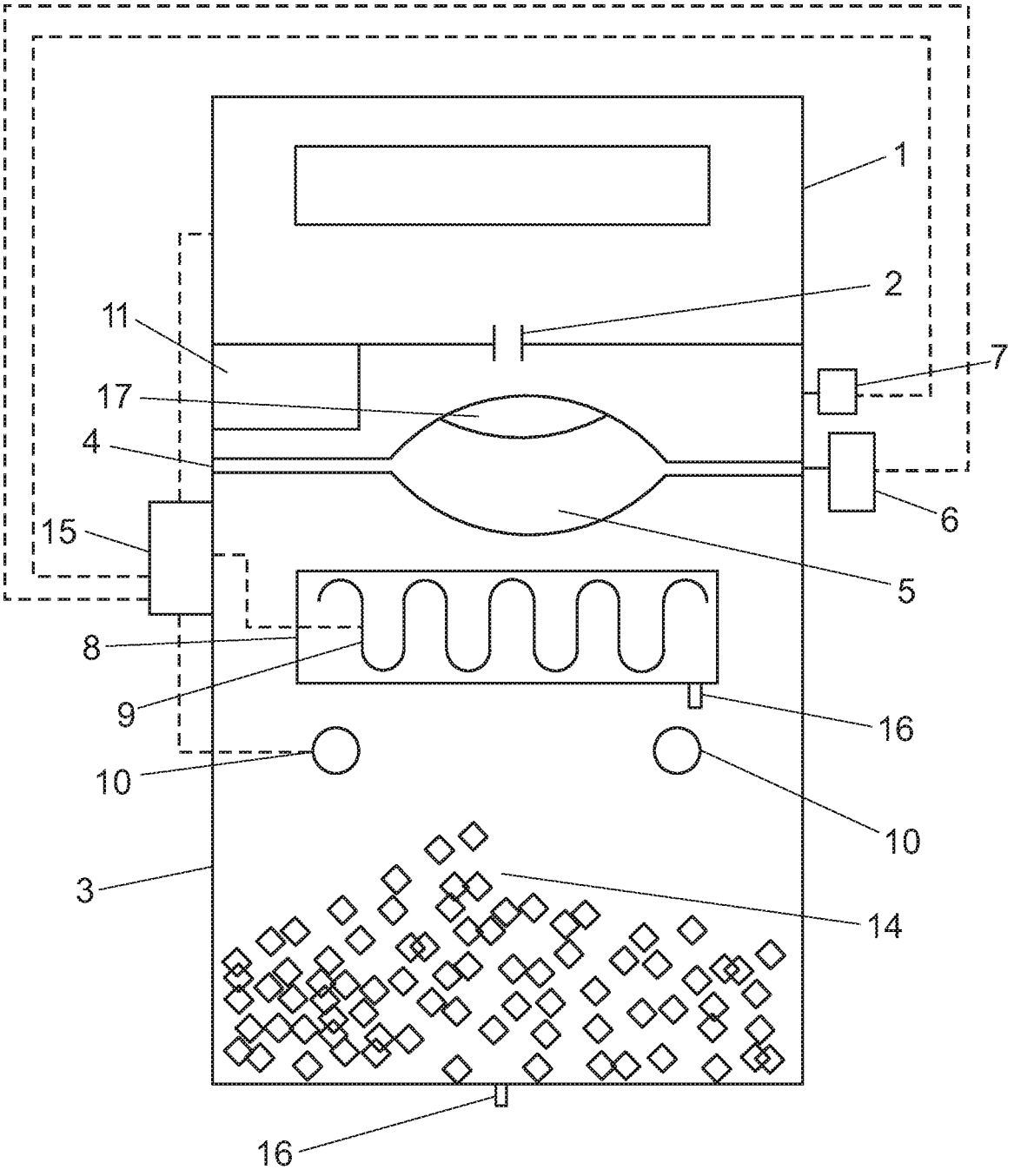

FIG. 2 shows a cross-sectional view of the bulk ice preserver.

Figure 3:
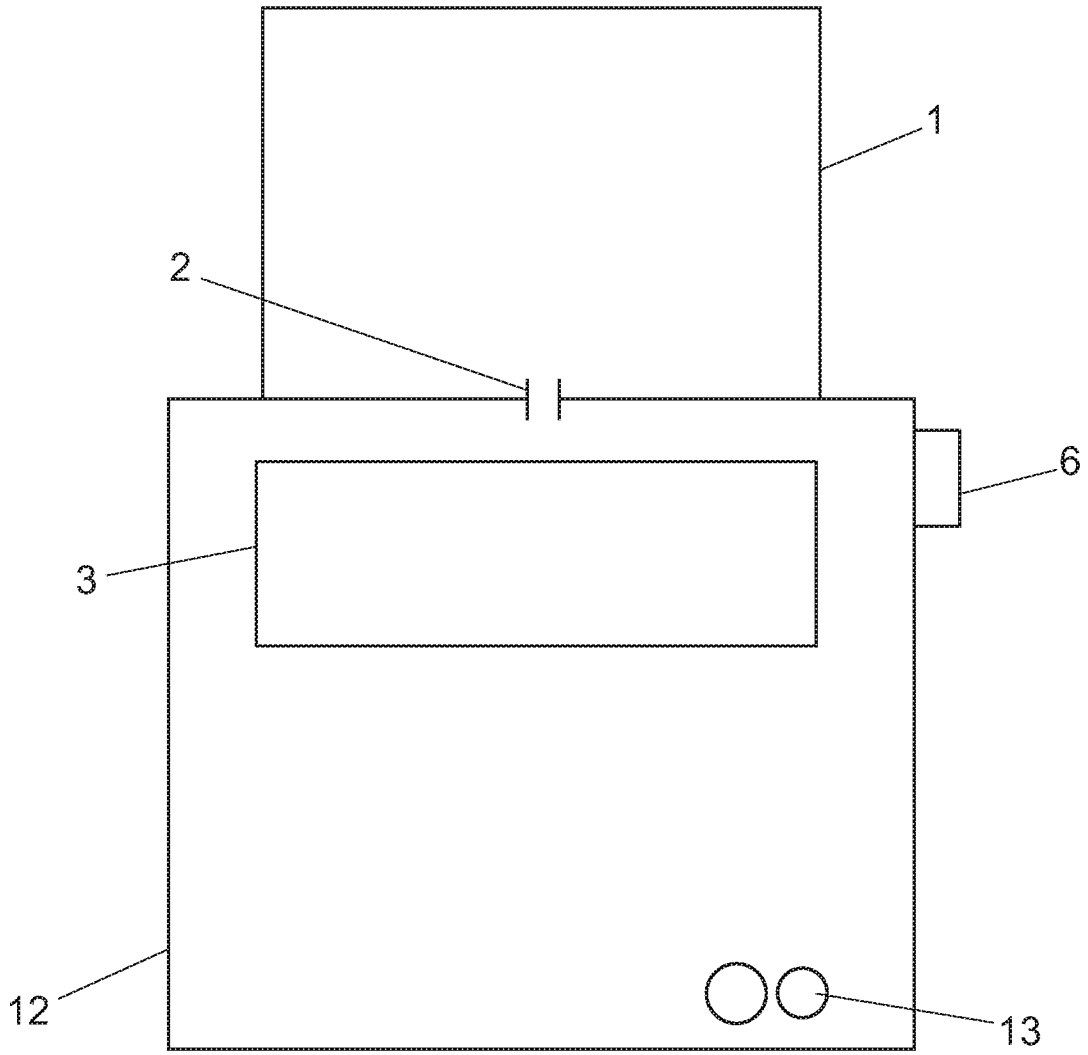

FIG. 3 shows a perspective view of the bulk ice preserver.

DESCRIPTION OF A PREFERRED EMBODIMENT

Figure 1:
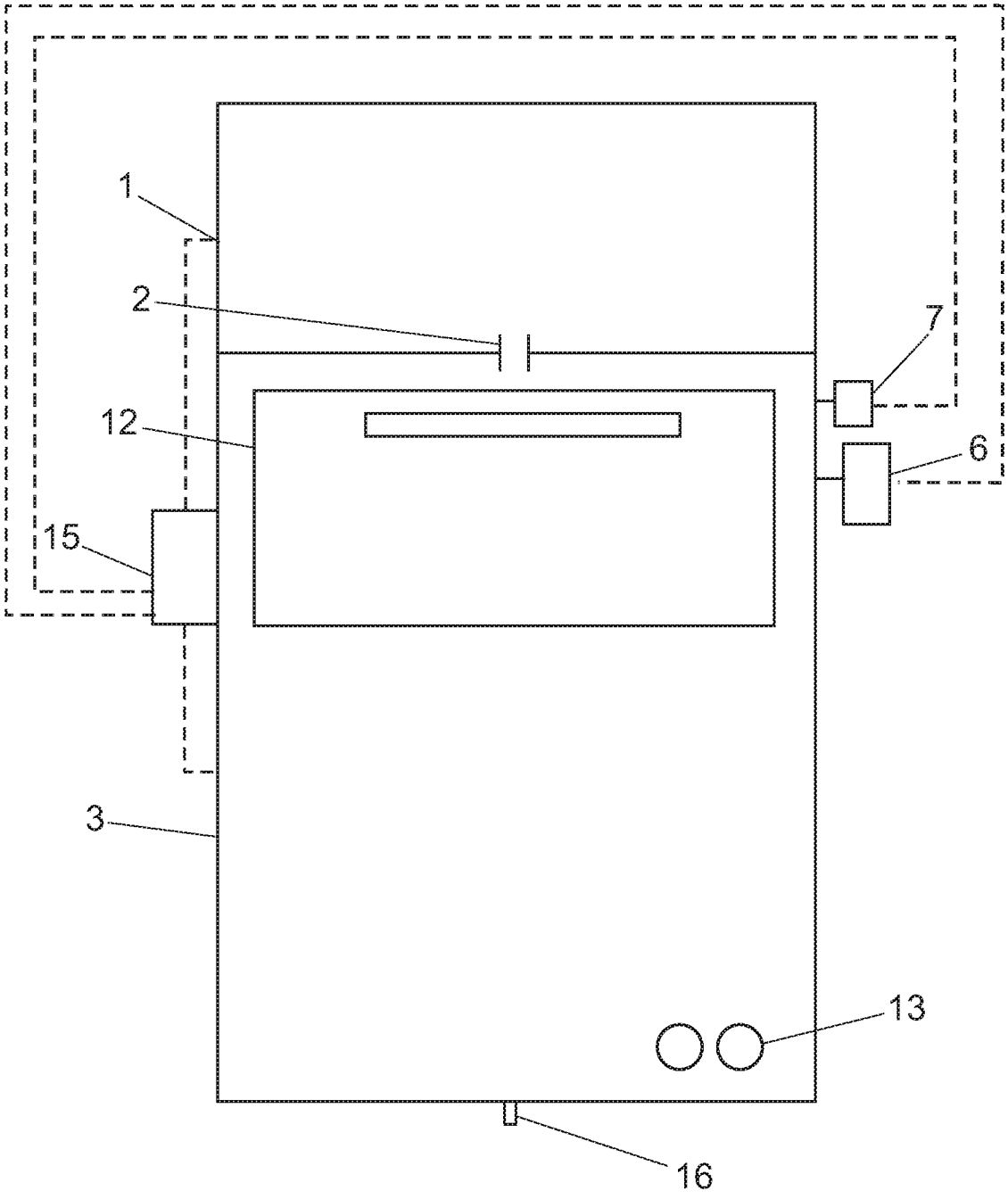
FIG. 1 shows an elevation view of the bulk ice preserver, wherein a series of references corresponding to the elements indicated below are provided in a non-limiting manner.

FIG. 1 shows an ice maker (1) which can make ice in any format and shape. The ice drying and storage compartment (3) is disposed underneath the ice maker. In those case where the ice maker (1) is not integrated in the bulk ice preserver, they will be joined by the ice discharge duct (2), wherein this duct (2) may have different shapes and sizes to transport the different ice formats produced by ice makers (1) to the drying and storage compartment (3).

When the ice cubes enter the drying and storage compartment (3), they are directly introduced in the ice drying receptacle (5) and the ice cubes turn over one another in a timed manner in the ice drying receptacle (5) to prevent them from sticking together, until the ice maker (1) sends a signal to the automaton or similar (15), indicating that it has a new ice-making cycle. At that point, the motor (6) rotates the ice drying receptacle (5) such as to place it in the position in which ice is discharged into the storage compartment (14), whereupon all the ice cubes fall into the storage compartment (14) and the motor (6) rotates the ice drying receptacle (5) again so as to place it in the loading position so that the ice cubes made by the ice maker (1) are introduced in the ice drying receptacle (5), wherein the ice cubes turn over one another in a timed manner due to the timed activation of the motor (6) to prevent the ice cubes from sticking together when they freeze inside the drying receptacle (5). This entire process is automatically repeated until the sensor or photocell (10) detects the presence of ice, due to which it sends the automaton (15) a signal to stop the production of the ice maker (1), because the storage area (14) of the drying and storage compartment (3) is full. When the operator removes the ice from the storage section (14) and releases the sensor signal (10), the ice maker resumes the production of ice and the entire foregoing process is repeated.

The invention claimed is:

1. A bulk ice preserver comprising:
an ice making device configured to produce ice cubes;
an ice drying and storage compartment coupled to the ice making device through a joining duct and configured to receive a plurality of ice cubes from the ice making device, the ice drying and storage compartment comprising a first drain and housing:
an ice drying receptacle, a waste collection tray with a second drain, and a storage portion, the ice drying receptacle comprising an opening and configured to:
receive, via the opening, a first plurality of ice cubes received from the ice making device,
rotate in first and second directions to cause the first plurality of ice cubes to turn over one another in a timed manner until the ice making device sends a signal to an automaton indicating that a new ice-making cycle has been created;
rotate to a selected position that causes the first plurality of ice cubes to fall out of the ice drying receptacle via the opening into the storage portion;
a fastening shaft configured to fasten the ice drying receptacle to an interior wall of the drying and storage compartment;
a first sensor configured to detect a position of the ice drying receptacle;
the storage portion configured to hold the plurality of ice cubes that have fallen from the ice drying receptacle;
a waste collection tray comprising a resistor and a second drain, the waste collection tray configured to collect water and pieces of ice generated by the ice drying process of the ice drying receptacle and water discharged by the ice making device, the resistor configured to melt the pieces of ice, the second drain configured to remove the water from the waste collection tray;
ice discharge doors configured to allow removal of ice cubes from the storage compartment; and
a second sensor configured to detect a quantity of ice stored in the storage compartment and to send signals to the ice making device based on a volume of the ice cubes present in the storage compartment; and
a motor having two directions of rotation, the motor being coupled to the fastening shaft and configured to cause the fastening shaft and the ice drying receptacle to rotate in the two directions, wherein the ice drying receptacle is a closed drum having a rotation axis going longitudinally through said closed drum, said rotation axis coinciding with the longitudinal axis of the fastening shaft.

2. The bulk ice preserver according to claim 1, wherein the ice drying receptacle is removably attached to the fastening shaft.

3. The bulk ice preserver according to claim 1, wherein the ice drying receptacle has a door configured to cover the opening.

* * * * *